United States Patent [19]

de Blauw

[11] Patent Number: 4,742,890

[45] Date of Patent: May 10, 1988

[54] WORK PLATFORM

[75] Inventor: Jakob de Blauw, Don Mills, Canada

[73] Assignee: Protective Plastics Limited, Scarborough, Canada

[21] Appl. No.: 111,802

[22] Filed: Oct. 22, 1987

[51] Int. Cl.[4] ..... E04G 5/08

[52] U.S. Cl. ..... 182/222; 182/46; 182/150

[58] Field of Search ..... 182/222, 223, 46, 142, 182/119, 217, 150

[56] References Cited

U.S. PATENT DOCUMENTS

| | | | |
|---|---|---|---|
| 2,225,737 | 12/1940 | Vaney | 182/222 |
| 3,260,522 | 7/1966 | White | 182/46 |
| 3,744,591 | 7/1973 | Lucci | 182/46 |
| 4,029,172 | 6/1977 | Green | 182/46 |
| 4,349,297 | 9/1982 | Misener | 182/222 |
| 4,496,029 | 1/1985 | Kuroda | 182/222 |
| 4,520,897 | 6/1985 | Gebo | 182/46 |
| 4,655,321 | 4/1987 | Salvarezza | 182/46 |
| 4,683,981 | 8/1987 | Salvarezza | 182/46 |

FOREIGN PATENT DOCUMENTS

| | | | |
|---|---|---|---|
| 1029163 | 4/1978 | Canada . | |
| 660391 | 4/1987 | Switzerland | 182/222 |

OTHER PUBLICATIONS

Protective Plastics Limited, "Suspension Platform Meets Critical Standards", Electrical Equipment News, Nov. 1985, p. 30.

Chance Catalogue, pp. 3D-3 and 3D-9.

*Primary Examiner*—Reinaldo P. Machado

[57] ABSTRACT

A work platform comprising a moulded polymeric resin fibre-reinforced generally channel-section shell having a lip flange extending inwardly from each channel side, and comprising tensile elongation resisting reinforcement comprising fibres extending longitudinally at least along marginal zones of the channel base and of the lip flanges adjacent the channel sides, and said channel sides comprising fibrous reinforcement resisting tensile elongation of said sides in the direction perpendicular to said marginal zones, whereby said platform is rendered substantially rigid to bending about axes transverse of said channel structure.

18 Claims, 4 Drawing Sheets

WORK PLATFORM

The present invention relates to a work platform and more especially although not exclusively to a lineman's suspension platform. The latter platforms are used by linemen in working on high tension electrical power transmission lines and their associated components adjacent to support towers, for example in repairing or maintaining the array of insulators arranged between the support towers and the high tension lines. In use, one end of the platform is usually suspended from the tower and an opposite end from the transmission line outwardly from the tower. The suspended structure thus provides a platform on which the lineman or crew of linemen can stand, sit and rest their tools while performing operations on the insulators. It is required that the platform should provide a stable surface and should normally have adequate strength and rigidity to withstand the weight of at least two linemen and their tools without bending unduly or breaking. In the case in which the platform is to be used in association with electrical power transmission lines, it should be electrically insulating to avoid creating a conductive path between the transmission line and an electrical ground, e.g. a support tower. Further the platform should desirably be lightweight to facilitate handling of the platform, for example hoisting it onto the tower and its deployment to and retrieval from the suspended position.

It is known to employ platforms made from wood, but these are heavy and inconvenient to lift and manipulate. Further, the electrical resistance properties and the strength of wooden platforms deteriorate rapidly when the wood becomes wet. It is also known to employ fibre-reinforced, polymeric resin platforms. Although stronger, lighter and better insulating than wood, the known structures are not as lightweight and as strong as is desirable.

According to the present invention there if provided a work platform comprising a moulded polymeric resin fibre-reinforced generally channel-section shell having a lip flange extending inwardly from each channel side, and comprising tensile elongation resisting reinforcement comprising fibres extending longitudinally at least along marginal zones of the channel base and of the lip flanges adjacent the channel sides, and said channel sides comprising fibrous reinforcement resisting tensile elongation of said sides in the direction perpendicular to said marginal zones, whereby said platform is rendered substantially rigid to bending about axes transverse of said channel structure.

With this arrangement, bending of the platform about transverse axes is resisted, since bending whether to an upwardly concave or to an upwardly convex flexed position cannot occur without the elongation resistant upper and lower marginal zones at each side separating or slipping longitudinally relative to one another, and such separation and slipping is resisted by these marginal zones being tied together by the fibre reinforced channel sides. The manner in which the interconnected tensile elongation resistant upper and lower marginal zones in the present platform impart rigidity is in principle somewhat similar to the manner in which an I-beam achieves rigidity by employing relatively heavy upper and lower flanges interconnected by a relatively thin web. Thus each channel side in the present platform provides a strong, highly rigid structure capable of withstanding heavy loads without breaking or bending to an unacceptable degree. Since the structure efficiently utilizes the strength and tensile elongation resistance of the fibrous reinforcement material, it allows relatively high strength structures to be achieved using a relatively thin lightweight shell.

In the preferred form, the elongation resistant longitudinal fibres comprise aramid fibres for example those available under the trade mark KEVLAR. Aramid fibres have excellent electrical resistance, and are lightweight while possessing high tensile strength and modulus, and are thus outstanding useful as the longitudinal reinforcing fibres of the platform of the present invention. It will be appreciated, however that the invention is not limited to the use of aramid fibres and that, where such other fibres are available, other preferably non-conductive fibres of tensile modulus at least approximating that of aramid fibres may be employed.

One form of platform according to the present invention will now be described in more detail, by way of example only, with reference to the accompanying drawings in which.

Figure 1:
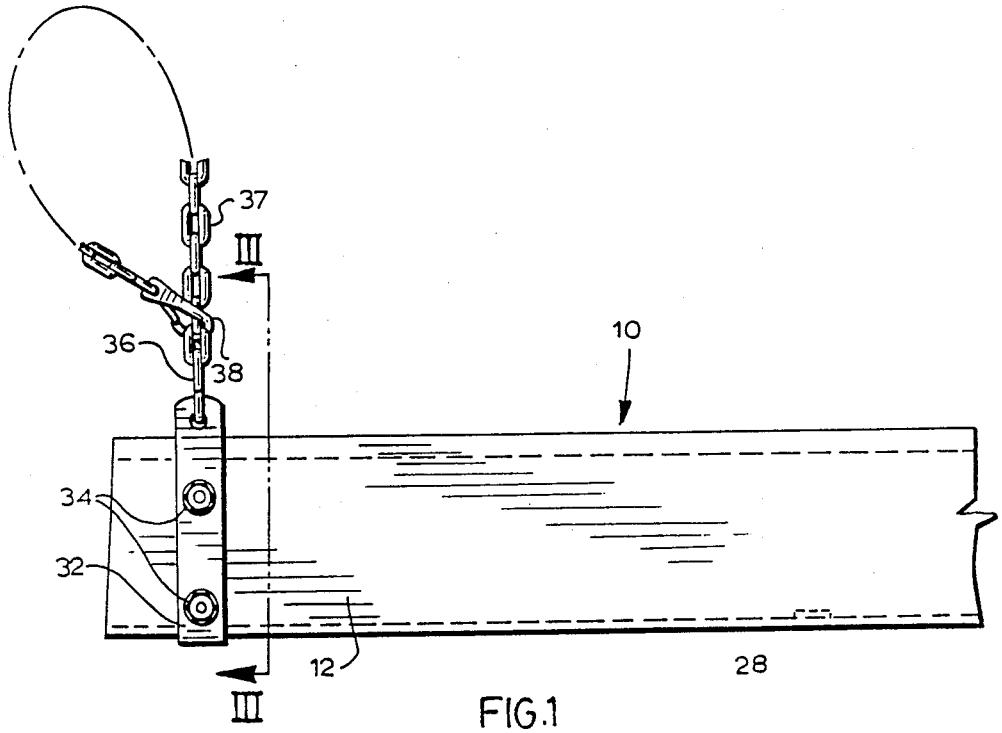
FIG. 1 shows a partial side view of one end and FIG. 2 a partial side view of the opposite end of a lineman's suspension platform in accordance with the invention, together with connectors for connecting the platform to a transmission tower and to a high tension line.
Figure 3:
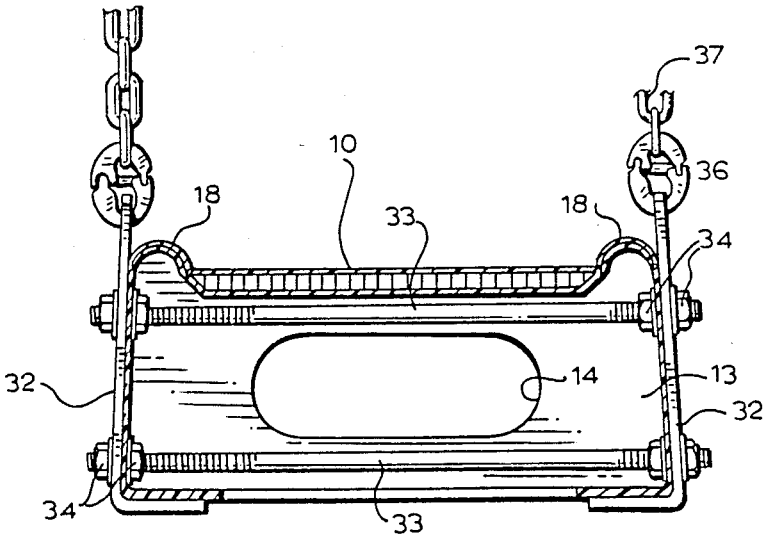
FIGS. 3 and 4 show cross-sections taken on the lines III—III and IV—IV in FIGS. 1 and 2, respectively.
Figure 4:
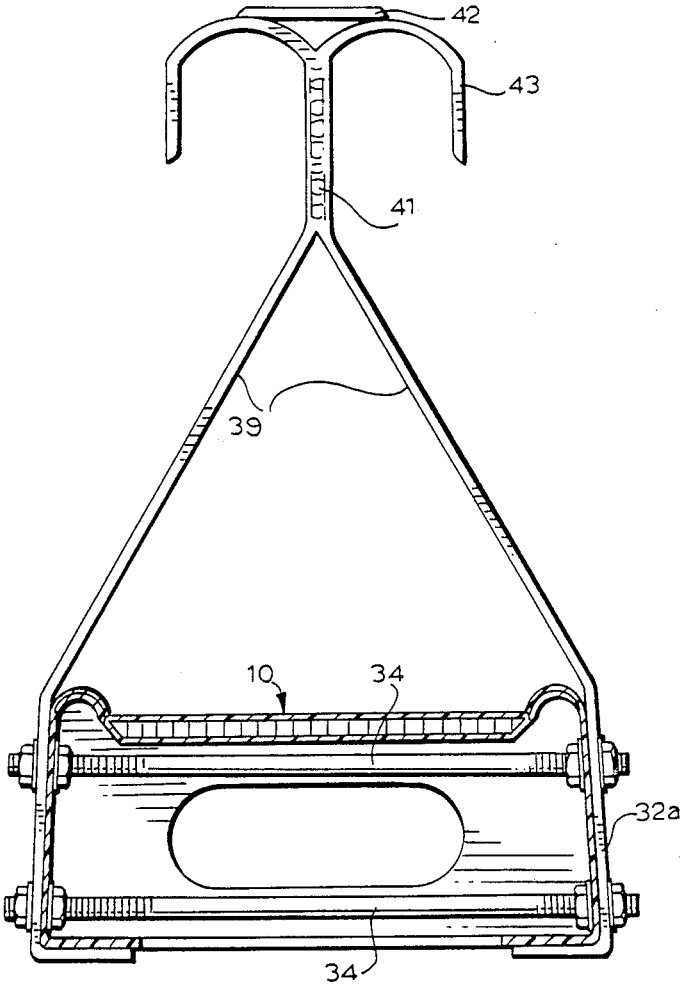

Referring to the accompanying drawings, the platform 10 comprises a moulded polymeric resin fibre-reinforced thin shell which is generally of an inverted channel section comprising a channel base 11 and channel sides 12. Each end of the channel is closed by an end wall 13 formed integrally with the base and side walls 11 and 12. An oval hand hold hole 14 is formed through each end wall 13.

The lower or free end of each channel side 12 extends inwardly in a lip flange 16 integral with the side 12, and each end wall 13 continues inwardly in an integrally connected short end flange 17.

Between each longitudinal edge of the base 11 and the adjacent channel side 12, the shell comprises an outwardly convex raised portion 18 projecting upwardly in the direction opposite to the direction in which the sides 12 extend. The arcuate portion 18 blends smoothly with the base 11 and sides 12. It provides a raised border along each edge of the platform preventing tools or the like from rolling off the edge of the platform and providing greater security for linemen standing on the platform or sitting on its edge by reducing any risk of them sliding off the edge.

The platform is preferably manufactured by moulding the channel section portion comprising the base 11, portions 18, sides 12 and ends 13 in one piece in a mould of corresponding closed-ended generally channel shape. As will be noted from the drawings, the end walls 13 and side walls 12 have a slight downward outward flare or draft to facilitate removing the finished item from the mould. A planar portion comprising the lip and end flanges 16 and 17 may be moulded on a separate planar or shallow tray-like mould, and then the two portions are bonded together.

In the course of moulding the platform 10 fibrous reinforcement is embedded in the polymeric resin composition constituting the matrix of the moulded shell. Where the moulded platform is to be employed as a work platform for use in servicing high tension transmission lines, for example as a lineman's suspension platform, all fibrous reinforcement used therein should be electricaly non-conductive.

Figure 6:
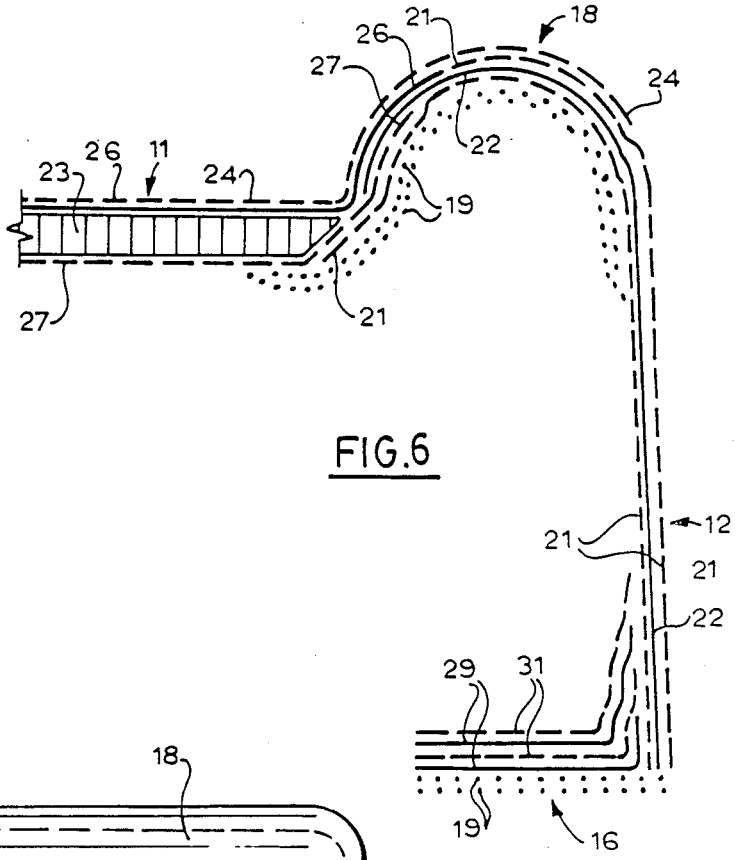
FIG. 6 is a somewhat schematic partial cross-section through the platform illustrating the arrangement of various fibre and other reinforcement layers.
Figure 7:
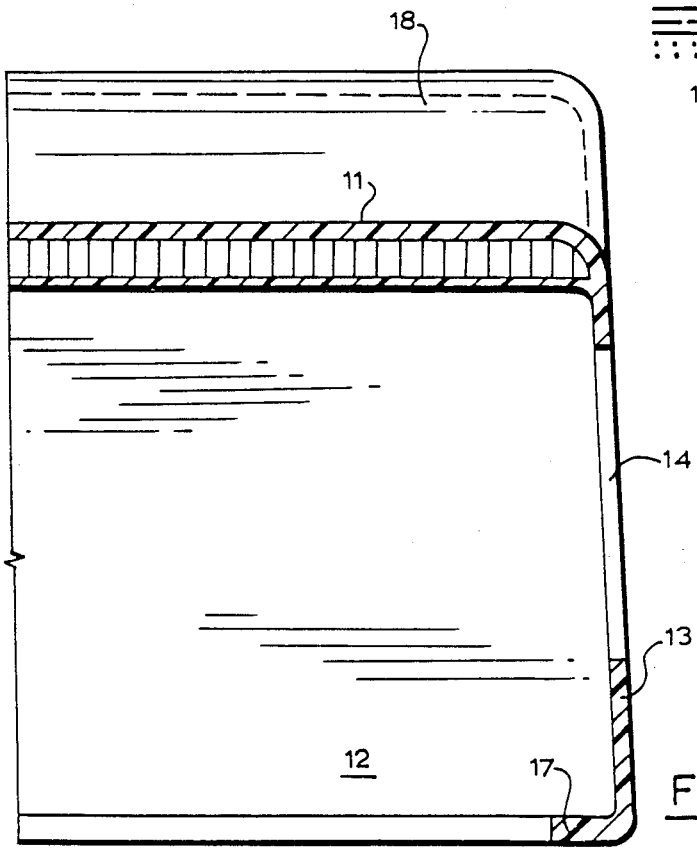
FIG. 7 is a longitudinal cross-section through the platform taken on a median line VII—VII in FIG. 5.

The distribution of the fibrous reinforcement in a preferred form is shown somewhat schematically in cross-section in FIG. 6. The reinforcement comprises sets of tensile elongation resisting fibres 19 extending longitudinally along each lip flange 16 and along each arcuate portion 18 and adjacent portions of the channel base 11 and sides 12, from one end of the platform to the other. As seen in FIG. 6, each set comprises two layers of band- or tape-like reinforcement material, indicated in cross-section by round dots. Each layer may, for example, comprises a tape of unidirectional fibrous reinforcement, comprising parallel yarns of fibre loosely bound together with cross-woven threads or yarns.

In the preferred form, the longitudinal fibres 19 are KEVLAR or other non-conductive aramid fibres or are non-conductive fibres of tensile modulus at least equal to KEVLAR fibres, since such fibres offer high tensile modulus with relatively low weight, and thus provide excellent rigidity even where the shell of the platform is made relatively thin and light in weight. Preferably, the fibres are substantially continuous from one end of the platform to the other, since plastics structures having embedded continuous fibres offer increased resistance to elongation as compared with reinforced structures comprising staple fibre reinforcement.

Further, the sides 12 of the channel each comprise fibrous reinforcement resisting tensile deformation of the sides 12 in the direction perpendicular to the general plane of the channel base 11. Such reinforcement may comprise a layer or preferably two layers of woven fabric 21, indicated by dashed lines in FIG. 6 and/or a fibrous mat 22 comprising randomly disposed staple fibres, preferably glass fibres, indicated by a solid line, bonded together by a bonding agent, e.g. a resin. The woven fabric reinforcement preferably comprises warp and weft yarns of the same denier, of KEVLAR fibre or the like.

With the above arrangement, the longitudinally disposed fibres 19 in the upper and lower flange-like portions 16 and 18 effectively resist elongation of either of the portions 16 and 18. Since the fibres 19 are anchored in the matrix of the resin composition within which they are embedded, and the adjacent portions 16 and 18 are effectively tied together by the fibre-reinforced side wall 12, the sides of the platform constitute I-beam-like rigid structures which, while relatively thin and lightweight serve to resist bending of the platform about transverse axes parallel to the channel base. Thus the platform can, for example, withstand heavy loads applied adjacent its centre while being suspended from each end without unduly bending and without yielding or breaking.

It is desirable to rigidify the base 11 of the channel, which forms the upper surface or deck of the platform in use, so that the surface does not flex locally beneath and adjacent the feet of persons walking on the base 11 and does not therefore give a sensation of the base being unstable or insecure. In the preferred form this is achieved by embedding within the resin composition of the base 11 a lightweight rigid core 23. Desirably, the material of the core 23 is substantially non-absorbent so that it does not absorb liquid resin during the manufacturing operation which would tend to add to the weight of the core and hence of the platform as a whole as well as increase the consumption of resin. The core material may for example comprise balsa, preferably in the form of blocks of balsa mounted mosaic-fashion on a flexible backing or scrim, so that when placing the core material in the mould the material can be flexed to conform to any irregularities of the mould or of preceding layers of the partly finished platform. When the resin is solidified or hardened, it bonds the blocks together to form a rigid sheet-like core. Desirably, the blocks are disposed with their end grain at the upper and lower surfaces of the core so that there is slight absorbency toward the liquid resins thus improving the keying or bonding between the resin and the core. Alternatively, in place of the balsa rigid closed cell plastics foams can be employed, for example polyurethane, polyester or polyvinyl chloride foams.

In order to further rigidify the deck or base 11, fibrous reinforcement, preferably in the form of a KEVLAR woven fabric web is embedded in the polymeric resin on each side of the core 23 and is thereby bonded to the core 23, so as to resist lateral elongation or expansion of the shell on either side of the core 23 and thus resisting flexing of the base 11. In the example shown in FIG. 6, an outer woven fabric web 24 is disposed adjacent an outer side of the core 23 above an intermediate layer of fibrous mat 26 comprising bonded randomly disposed staple fibres, and an inner woven fabric web 27 is disposed adjacent the inner side of the core 23. As seen in FIG. 6, the edges of the layers 24 and 27 overlap laterally outwardly from the edge of the core 23, the edge of the core 23 is overlapped by the edges of the tapes 19 of the longitudinal fibres, and the various layers are interleaved with the edges of the woven fabric and mat reinforcements 21 and 22 of the sides 12 in the region of the arcuate portion. Thus, when the various fibre layers are bonded together with the resin composition, the base 11, portion 18 and sides 12 are securely united together. In order to allow the layers to be brought into close face to face bonding relationship adjacent the edges of the core 23, the latter preferably thins towards its edges, e.g. it is rounded, tapered or chamfered as shown, so that the layers of reinforcement can be pressed together closely and embedded in the liquid resin during manufacture without air inclusions being formed between the layers which would lend to points of weakness in the final platform.

In order to render the platform more stable and resist any tendency for the channel sides 12 to splay outwardly when a load is placed on the upper surface of the base 11, the lower edges of the sides 12 are desirably interconnected at regular intervals by tie means connecting transversely between the channel sides 12, preferably adjacent the lower or free ends thereof. Although various forms of mechanical connection would be used, in the preferred form, for increased strength without adding greatly to the weight of the platform, the tie means comprise bar-like fibre-reinforced moulded resin elements 28 which are securely bonded with resin composition at each end thereof to the lip flanges 16 having the longitudinal fibres 19 embedded therein. By way of example, in the case of a platform approximately 28 cm wide and 11 cm high, such tie elements 28 may be placed approximately each 90 to 100 cm apart along the length of the platform. Advantageously for increased resistance to deformation of the platform without considerably adding to the overall weight, the elements 28 have longitudinally extending fibrous reinforcement extending through them from one end to the other, for example in the form of the unidirectional KEVLAR fibrous tapes 19 employed in the flanges 16 and portions 18.

The present platform may be manufactured using procedures which are generally conventional for moulding of fibre-reinforced resin elements. Generally, the layers of fibre and other reinforcement are placed in a mould, and there is applied to the reinforcement a liquid precursor of a resin which can be solidified or hardened to yield a solid or cured resin. For example, the liquid resin may be applied to the internal surfaces of the mould and to the layers of reinforcement by brushing to achieve a thin shell structure. Although thermoplastics resin compositions may be employed, for reasons of increased strength, durability, heat resistance, and economy and convenience of manufacture, the resin composition employed is desirably a thermosetting resin composition comprising a mixture of polymerizable liquid resin and a liquid curing agent therefor, which sets up to form a cured resin matrix or continuous phase surrounding and embedding the fibrous and other reinforcement layers. The polymerizable liquid resin may be, for example an epoxy resin, but is preferably a vinyl ester resin which cures without requiring heating, and may for example be any room temperature curing vinyl ester resin of the type conventionally used for production of resin reinforced plastics articles using hand lay up techniques. Before applying the resin to the mould or to the fibres, it may be mixed with a curing agent which for example in the case of vinyl ester resin may be any curing agent composition used with vinyl ester polymers, and for example may comprise methyl ethyl ketone peroxide and metal salts such as cobalt napthenate.

Preferably, all or substantially all areas of the generally channel section moulded shell 10, namely the base 11, portions 18, sides 12 and sides and end lip flanges 16 and 17 comprise embedded therein at least one, and preferably two, thicknesses of a woven fabric reinforcement of fibres of KEVLAR or of a material of at least equal tensile modulus. As seen in FIG. 6, such woven fabric reinforcement 21 and 24 is present in the base 11, portions 18 and sides 12. The lip flanges 16 and 17 are preferably of the same constitution of internal fibrous reinforcement and preferably comprise, superimposed on the unidirectional fibrous tape reinforcement 19, layers of fibrous mat reinforcement 19 comprising bonded-together randomly disposed staple glass fibres, interleaved with two layers 31 of the woven fabric KEVLAR reinforcement or the like.

In the course of laying up the layers of fibrous reinforcement, the use of the layers of fibrous mat reinforcement comprising randomly disposed staple fibres, such as the mats 22, 26 and 29 facilitates placement of the woven fabric KEVLAR reinforcement layers 21, 24 and 31. The KEVLAR woven fabric is relatively stiff and tends to offer resistance to conforming to the shape of the interior of the mould, and it is useful to bed the KEVLAR woven fabric down under a layer of the fibrous mat staple fibre reinforcement which, when wetted with resin composition, tends to retain the KEVLAR woven fabric material in place. In the preferred form, the mat material 22, 26 and 29 comprises staple glass fibres bonded together with a resin binder which softens and partially dissolves in the thermosetting resin composition which is brushed on or otherwise applied, so that the glass fibre mat tends to soften and conform relatively easily to the moulded surfaces.

In the preferred form, the upper surface of the base 11 of the inverted channel section shell has fine grit-like particulate material embedded therein, which renders the surface skid-resistant or anti-slip. A suitable particulate material is, for example, foundry sand.

In the course of manufacturing the platform, conveniently the channel section portion comprising the base 11, portions 18 and sides 12 is moulded separately in a corresponding channel section mould, which may be release coated with a wax composition or the like. Advantageously, the first layer of resin applied in the mould is a gel coat comprising hardenable polymer compatible with the remaining resin layers to be applied, and which will set up to form a smooth or continuous outer layer on the finished item. Desirably, the gel coat contains pigment which renders the structure opaque and an ultraviolet light absorber which prevents ultraviolet light from causing degradation of the polymer composition of the finished article in use. The layer of gel coat composition applied in the region of the base 11 may have mixed into it the sand or other particulate material to render the upper surface of the base 11 anti-slip. Subsequent layers of fibres, balsa or other reinforcement are added progressively to the interior of the mould and conformed to the preceding layers. Usually each fibrous reinforcement layer is added dry and the liquid resin composition brushed or otherwise applied to the reinforcement material placed within the mould. For convenience of moulding, the rectangular portion having a rectangular aperture therein made up by the side and end lip flanges 16 and 17, and at this stage containing only the unidirectional tape reinforcements 19 is desirably moulded separately on a planar tray-like mould. The end lip flanges 17 may, for example, comprise relatively narrow portions of the tape reinforcement 19 extending transversely across and overlapping the ends of the fibrous reinforcement 19 of the side lip flanges 16. After hardening of the rectangularly apertured structure, this is placed on the edges of the moulded sides 12, and is secured thereto with application of successive layers of the fibrous reinforcements 29 and 31 to the inner adjacent surfaces of the sides 12, ends 13 and the partially moulded flanges 16 and 17, each successive layer of reinforcement having the liquid resin composition brushed on or otherwise applied thereto to build up a secure bond between the sides 12, ends 13 and flanges 16 and 17. The separately laid up moulded and cured rectangular tie elements 28 can then be introduced into the structure and have their ends bonded to the upper sides of the flanges 16 with resin composition.

It may be mentioned that in the case of platforms of substantial length, e.g. of about 4.5 to 5 metres in length, it will normally be desirable to employ an additional layer of KEVLAR or the like woven fabric reinforcement disposed on the inner sides of the portions 18, the sides 12 and the flanges 16 in the central region of the platform, for example over a length of about 50 cm on each side of the middle of the platform.

Holes 14 may be cut through the end walls 13 of the structure after the shell has cured, and desirably the edges of the holes are smoothed, e.g. with an abrasive, and then coated if necessary with a thin film of resin composition to avoid sharp edges or protrusions which might injure the hands of a user.

The above description provides ample information to allow one skilled in the art to fabricate the platform described above in detail with reference to the accompanying drawings. For the avoidance of doubt some specific examples will be given of typical fibrous and other reinforcement that may be employed. For example, the fibrous mat materials 22, 26 and 29 may comprise 450 g/m$^2$ chopped strand glass fibre mat obtained from Fiberglas Canada Inc., and the woven fabric materials 21, 24, 27 and 31 may comprise 500 KEVLAR cloth and the undirection tape materials 19 may be 7.62 cm wide undirectional KEVLAR comprising parallel strands with polyester cross ties, both obtained from Bay Mills Limited, Midland Division, Midland, Ontario. The balsa layer 23 may comprise 6.35 mm thick end grain balsa blocks on a scrim backing available under the trade mark CONTOURCORE from Baltek Corp., Northvale, New Jersey, U.S.A.

Figure 2:
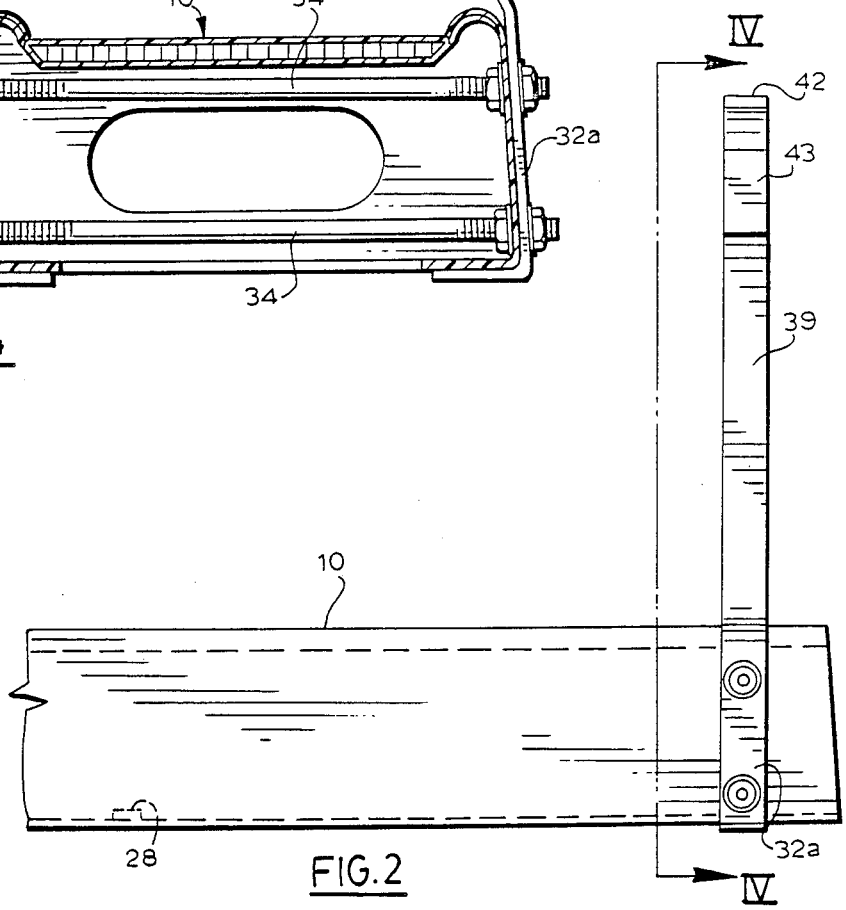
Figure 5:
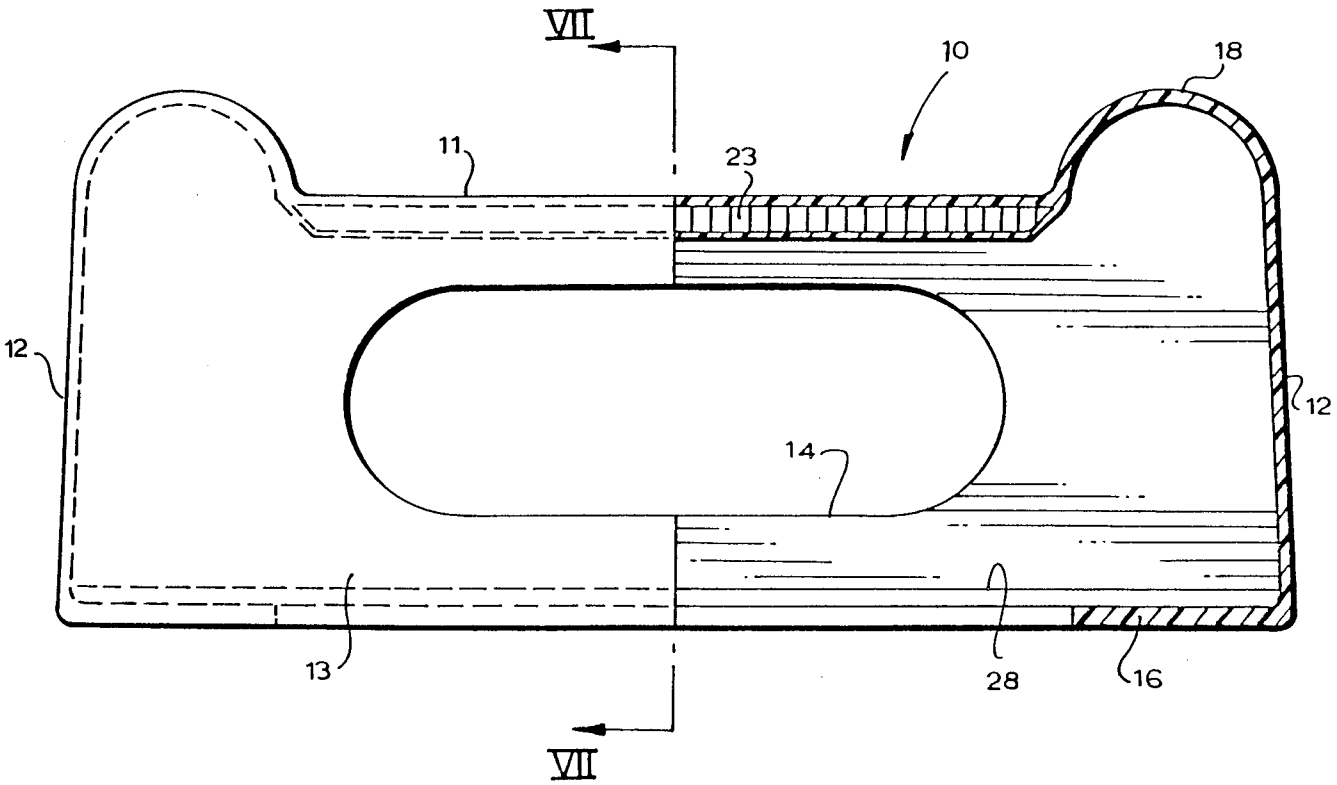
FIG. 5 shows an end view partially in cross-section.

With reference to FIGS. 1 to 4, these show metal chains and hooks for suspending the platform from a support tower and from a transmission line, respectively. As seen in FIG. 1 and 2, at one end a pair of L-brackets 32 are secured, one on each side wall 12 with upper and lower threaded rods 33 passed through the brackets and through apertures in the side walls 12 and secured with washers and nuts 34 to the walls 12. Each bracket 32 has an opening at its upper end through which is connected a link 36 connecting to a chain 37, the opposite end of which, after passing around a strut or the like on a tower, may be secured in a loop to the chain 37 with a snap connector 38. The opposite end of the platform 10 has secured to it a similar assembly of L-brackets **32*a* and threaded rods 33. There, however, the brackets 32*a* are formed integrally with bars 39 inclining upwardly and inwardly, welded together at 41 and bridged with a welded-on strap 42 and each curved at its end to form a downwardly open hook 43** which may in use be hooked over a transmission line or the like.

I claim:

1. A work platform comprising a moulded polymeric resin fibre-reinforced generally channel-section shell having a lip flange extending inwardly from each channel side, and comprising tensile elongation resisting reinforcement comprising fibres extending longitudinally at least along marginal zones of the channel base and of the lip flanges adjacent the channel sides, and said channel sides comprising fibrous reinforcement resisting tensile elongation of said sides in the direction perpendicular to said marginal zones, whereby said platform is rendered substantially rigid to bending about axes transverse of said channel structure.

2. Platform according to claim 1 wherein said longitudinally extending fibrous reinforcement has a tensile modulus approximately that of aramid polymer.

3. Platform according to claim 2 wherein said longitudinally extending reinforcement comprises KEVLAR (trade mark) fibres.

4. Platform according to claim 1 wherein said longitudinally extending reinforcement comprises substantially continuous fibres.

5. Platform according to claim 1 including tensile elongation resisting tie means connecting transversely between said channel sides.

6. Platform according to claim 1 wherein said tie means comprise moulded polymeric resin fibre-reinforced elongate elements having longitudinally extending fibrous reinforcement, said elements being spaced longitudinally along the platform and each being connected at each end to said marginal zones of said flanges.

7. Platform according to claim 1 comprising a core of lightweight substantially non-absorbent rigid material embedded in the resin comprising the channel base.

8. Platform according to claim 7 wherein said sheet material comprises balsa or a closed cell rigid plastics foam.

9. Platform according to claim 7 wherein said sheet material generally tapers in thickness toward each longitudinal edge.

10. Platform according to claim 7 comprising longitudinal and transverse elongation resisting fibre embedded in the resin composition of the shell adjacent the upper and lower surfaces of said core.

11. Platform according to claim 1 wherein said shell comprises a raised portion projecting upwardly in the direction opposite to said channel sides along each longitudinal edge of the channel base.

12. Platform according to claim 1 wherein the outer side of said channel base has anti-slip particulate material embedded therein.

13. Platform according to claim 1 wherein said shell comprises end walls integral with and closing the ends of said channel section.

14. Platform according to claim 1 wherein each end portion has a hand hold hole therethrough.

15. Platform according to claim 1 wherein said channel section shell comprises embedded therein over substantially its entire area at least one layer of a woven fabric reinforcement comprising aramid fibre or fibre of tensile modulus at least equal to aramid fibre.

16. Platform according to claim 15 wherein inwardly from said woven fabric reinforcement said shell comprises embedded therein a layer of glass fibre reinforcement.

17. Platform according to claim 16 wherein said glass fibre reinforcement comprises glass fibre mat.

18. Platform according to claim 1 wherein said reinforcement comprises electrically non-conductive fibres.

* * * * *